United States Patent [19]

Houck et al.

[11] Patent Number: 4,716,019

[45] Date of Patent: Dec. 29, 1987

[54] PROCESS FOR PRODUCING COMPOSITE AGGLOMERATES OF MOLYBDENUM AND MOLYBDENUM CARBIDE

[75] Inventors: David L. Houck, Towanda; David J. Port; Jen S. Lee, both of Sayre, all of Pa.

[73] Assignee: GTE Products Corporation, Stamford, Conn.

[21] Appl. No.: 58,213

[22] Filed: Jun. 4, 1987

[51] Int. Cl.[4] ..... B22F 1/00

[52] U.S. Cl. ..... 419/17; 75/0.5 AC; 75/0.5 BC; 75/240; 75/251; 419/23; 419/31; 419/32; 419/33; 419/36; 419/58

[58] Field of Search ..... 75/0.5 AC, 0.5 BC, 251, 75/240; 419/17, 23, 58, 31, 32, 36, 33

[56] References Cited

U.S. PATENT DOCUMENTS

| | | | |
|---|---|---|---|
| 2,050,266 | 3/1936 | Boyer | 419/17 |
| 2,091,017 | 8/1937 | Schwarzkopf | 75/240 |
| 3,840,367 | 10/1974 | Rudy | 75/240 |
| 4,049,380 | 9/1977 | Yih et al. | 75/240 |
| 4,397,889 | 8/1983 | Benjamin et al. | 419/33 |
| 4,478,888 | 10/1984 | Benjamin et al. | 419/33 |
| 4,491,559 | 1/1985 | Grab et al. | 419/36 |

*Primary Examiner*—Stephen J. Lechert, Jr.
*Attorney, Agent, or Firm*—Donald R. Castle; L. Rita Quatrini

[57] ABSTRACT

A process is disclosed for producing composite agglomerates of molybdenum and molybdenum carbide ($Mo_2C$). The process involves forming a relatively uniform mixture of non-agglomerated molybdenum powder and carbon powder having a particle size of no greater than the particle size of the molybdenum powder. The amount of carbon powder is proportional to the amount of molybdenum carbide desired in the composite agglomerate. A slurry is formed of the mixture, an organic binder, and water with the amount of the binder being no greater than about 2% by weight of the mixture; and the powders are agglomerated from the slurry. The agglomerated powders are then classified to remove the major portion of the agglomerates having a size greater than about 170 mesh and less than about 325 mesh from the balance of the agglomerates. The balance of the agglomerates in which the particle size is −170 +325 mesh is then reacted at a temperature of no greater than about 1400° C. for a sufficient time in a non-carbonaceous vessel in a reducing atmosphere to form the composite agglomerates.

5 Claims, 1 Drawing Figure

PROCESS FOR PRODUCING COMPOSITE AGGLOMERATES OF MOLYBDENUM AND MOLYBDENUM CARBIDE

This invention relates to a process for producing composite agglomerates in which molybdenum and molybdenum carbide are uniformly distributed.

BACKGROUND OF THE INVENTION

In thermal spray applications, molybdenum carbide has not been conventionally used. However, in combination with pure molybdenum powder, it is used for certain wear resistant applications.

Up to this time, molybdenum-molybdenum carbide is produced by first forming molybdenum carbide and then incorporating it with molybdenum prior to subsequent processing to form spherical flowable agglomerates suitable for plasma spray applications.

It would be desirable to produce such composite powders with a reduced number of processing steps.

SUMMARY OF THE INVENTION

In accordance with one aspect of this invention, there is provided a process for producing composite agglomerates of molybdenum and molybdenum carbide ($Mo_2C$). The process involves forming a relatively uniform mixture of non-agglomerated molybdenum powder and carbon powder having a particle size of no greater than the particle size of the molybdenum powder. The amount of carbon powder is proportional to the amount of molybdenum carbide desired in the composite agglomerates. A slurry is formed of the mixture, an organic binder, and water with the amount of the binder being no greater than about 2% by weight of the mixture; and the powders are agglomerated from the slurry. The agglomerated powders are then classified to remove the major portion of the agglomerates having a size greater than about 170 mesh and less than about 325 mesh from the balance of the agglomerates. The balance of the agglomerates in which the particle size is −170 +325 mesh is then reacted at a temperature of no greater than about 1400° C. for a sufficient time in a non-carbonaceous vessel in a reducing atmosphere to form the composite agglomerates.

DETAILED DESCRIPTION OF THE INVENTION

Figure 1:
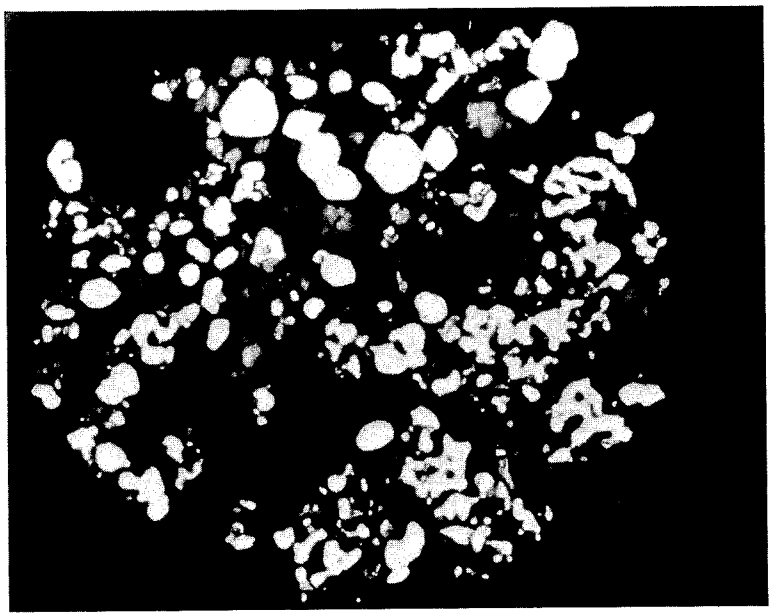
FIG. 1 is a photograph of a metallographically prepared cross-section of one of the agglomerates of this invention.

For a better understanding of the present invention, together with other and further objects, advantages and capabilities thereof, reference is made to the following disclosure and appended claims in connection with the above described figure and description of some of the aspects of the invention.

The present invention provides a process for producing composite powders of molybdenum and molybdenum carbide ($Mo_2C$) without the separate step of first forming molybdenum carbide. The amount of molybdenum carbide in the composite can be controlled by using the proportional amount of carbon in the initial molybdenum-carbon mixture.

According to the present invention, a relatively uniform mixture is formed of molybdenum and carbon.

The amount of carbon that is used is in proportion to the amount of molybdenum carbide desired in the final composite. For example, typically composites having from about 10% to about 90% by weight molybdenum are produced. This requires about 1% by weight carbon for every 17% of molybdenum carbide ($Mo_2C$) which is desired. It is preferred that the molybdenum powder be fine, that is, the average particle size be less than about 5 micrometers and preferably from about 3 to about 5 micrometers in diameter as measured by Fisher Sub Sieve size. A typical molybdenum powder that is used is Type 190 from GTE Corporation. A typical carbon powder is Type N-991 manufactured by Cancarb of Canada. The mixture can be formed by standard powder blending methods, such as V blending.

A slurry is then formed of the mixture, water and an organic binder. The most preferred binder is polyvinyl alcohol (PVA). A preferred type of this PVA is Monsanto's Gelvatol 20-30. A typical weight composition of the slurry is from about 60% to about 80% by weight solids and preferably from about 70% to about 75%. It is critical that the binder content of the slurry be no greater than about 2% by weight of the mixture. This insures that the subsequently produced agglomerates will have a spherical shape.

The powders are then agglomerated from the slurry. This is done typically by spray drying the slurry. The preferred spray drying conditions will be apparent in the Example that follows.

The agglomerates are then classified to remove the major portion of the agglomerates having a size of greater than about 170 mesh and less than about 325 mesh from the balance of the agglomerates. This is done preferably by screening techniques.

The balance of the agglomerates having the major portion in the −170 to +325 mesh size range is then reacted in a non-carbonaceous vessel at a temperature of no greater than about 1400° C. for a sufficient time in a non-oxidizing atmosphere, preferably a hydrogen atmosphere to form the molybdenum carbide and to sinter the composite agglomerates. When hydrogen gas is used, the flow rate is generally about 30 cfh. It is critical that the temperature not rise above about 1400° C. in order to avoid over sintering the material. The preferred temperatures are from about 1150° C. to about 1350° C. These temperatures are desirable because the the powder can be removed easily from the vessel and the agglomerates remain separate from one another so that a spherical flowable powder is maintained. It is preferred that the reaction time be from about 2 hours to about 6 hours. At higher temperatures and longer times in the hot zone of the furnace, the composite agglomerates sinter together. It is important that a non-carbonaceous vessel be used to avoid contamination of the powder with excess carbon and to avoid uneven distribution of carbon. Alumina boats are preferred vessels for the carburization reaction.

As a result of the process of the present invention, composite powder agglomerates of molybdenum and molybdenum carbide ($Mo_2C$) are produced which are spherical in shape and in which the molybdenum and molybdenum carbide components are uniformly distributed throughout each particle. Typically about 70% by weight of the agglomerates are in the −170 to +325 mesh range.

To more fully illustrate this invention, the following non-limiting example is presented. All parts, portions, and percentages are on a weight basis unless otherwise stated.

EXAMPLE

A mechanical blend consisting essentially of about 96.5% molybdenum and about 3.5% carbon is mixed in a slurry. The resulting slurry contains about 75% of the powders, about 0.75% polyvinyl alcohol, and the balance water. The slurry is vigorously agitated to maintain a homogeneous concentration of the mixture and then spray dried to yield agglomerates. The spray drying conditions are as follows using a two fluid nozzle:

Spray dryer—Proctor Schwartz Model 3A
Fluid Flow Rate—40 lbs/hr
Nozzle type—Spraying Systems 80/150-180
Air Pressure—40 psi
Inlet Temperature—450° F.-500° F.
Outlet Temperature—320° F.-330° F.

The resulting agglomerates are screened to remove the +170 −325 mesh agglomerates. The −170 +325 mesh agglomerates are placed in an alumina boat and introduced into a furnace with a hydrogen flow of about 30 cfh at a temperature of about 1150° C. for about 2 hours. Upon removal from the furnace, the powder is in a slightly hardened cake form. The powder is easily broken up to pass through a 170 mesh screen. The carbon analysis of the −170 mesh powder is about 3.55% and the corresponding x-ray evaluation yields about 59.3% $Mo_2C$. A metallographically prepared cross section of one of the agglomerates is shown in FIG. 1. This photograph shows a uniform mixture of molybdenum (light phase) and molybdenum carbide (dark phase).

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing composite agglomerates of molybdenum and molybdenum carbide ($Mo_2C$), said process comprising:

(a) forming a relatively uniform mixture of non-agglomerated molybdenum powder and carbon powder, said carbon powder having a particle size no greater than the size of said molybdenum powder, with the amount of said carbon powder being proportional to the amount of molybdenum carbide desired in said composite agglomerates;

(b) forming a slurry of said mixture, an organic binder, and water with the amount of said binder being no greater then about 2% by weight of said mixture;

(c) agglomerating the powders in said mixture from said slurry;

(d) classifying the resulting agglomerates to remove the major portion of the agglomerates having a size greater than about 170 mesh and less than about 325 mesh from the balance of said agglomerates; and (e) reacting said balance, the major portion of which has a size in the range of from about −170 mesh to about +325 mesh at a temperature of no greater than about 1400° C. for a sufficient time in a non-carbonaceous vessel in a non-oxidizing atmosphere to form said composite agglomerates.

2. A process of claim 1 wherein said molybdenum powder has an average particle size as measured by Fisher Sub Seive size of less than about 5 micrometers.

3. A process of claim 2 wherein said particle size of said molybdenum powder is from about 3 micrometers to about 5 micrometers.

4. A process of claim 1 wherein the reaction temperature is from about 1150° C. to about 1350° C.

5. A process of claim 4 wherein the time of reaction is from about 2 hours to about 6 hours.

* * * * *